US009027872B2

(12) United States Patent
Flood

(10) Patent No.: US 9,027,872 B2
(45) Date of Patent: May 12, 2015

(54) FREE STANDING DISPENSER APPARATUS FOR ROLLED SHEET MATERIAL

(71) Applicant: Rosemary Flood, Severn, MD (US)

(72) Inventor: Rosemary Flood, Severn, MD (US)

( * ) Notice: Subject to any disclaimer, the term of this patent is extended or adjusted under 35 U.S.C. 154(b) by 146 days.

(21) Appl. No.: 13/775,516

(22) Filed: Feb. 25, 2013

(65) Prior Publication Data

US 2014/0027560 A1 Jan. 30, 2014

Related U.S. Application Data

(60) Provisional application No. 61/676,143, filed on Jul. 26, 2012.

(51) Int. Cl.
*B65H 16/06* (2006.01)
*A47K 10/38* (2006.01)

(52) U.S. Cl.
CPC ..... *A47K 10/3827* (2013.01); *A47K 10/38* (2013.01); *A47K 10/3836* (2013.01)

(58) Field of Classification Search
CPC . A47K 10/32; B65D 83/0805; B65H 35/0006
USPC ..... 242/597, 597.7, 597.8, 596.8, 588, 242/588.3, 588.6, 405; 206/389, 408, 409
See application file for complete search history.

(56) References Cited

U.S. PATENT DOCUMENTS 299,943 A * 6/1884 West ..... 242/588.3
342,354 A * 5/1886 Harper ..... 242/405
415,423 A * 11/1889 Smith ..... 242/405
686,324 A 4/1901 McKay
1,097,385 A * 5/1914 Barns ..... 206/409
1,518,749 A * 12/1924 Nelson ..... 225/67
1,588,577 A * 6/1926 Heifler ..... 242/588
1,592,030 A * 7/1926 Langsner ..... 242/395.1
1,610,736 A * 12/1926 Blevins ..... 242/396.6
2,440,974 A * 5/1948 Resch ..... 312/31
2,752,106 A * 6/1956 Thompson ..... 242/422.5
3,208,121 A * 9/1965 Price ..... 242/388.1
3,490,578 A * 1/1970 Speakman ..... 206/409
3,549,006 A * 12/1970 Meierhoefer ..... 242/588.3
3,843,071 A * 10/1974 Graham ..... 242/588.6
4,108,390 A * 8/1978 Hayes ..... 242/588.6
4,192,561 A * 3/1980 Gunn ..... 312/42
4,273,392 A * 6/1981 Stinson ..... 312/42
4,432,451 A * 2/1984 Hooser ..... 206/216
4,436,224 A * 3/1984 McInerny ..... 222/183
4,690,345 A * 9/1987 Cotey ..... 242/613.5
4,739,943 A * 4/1988 Geller ..... 242/590
4,848,575 A * 7/1989 Nakamura et al. ..... 206/449

(Continued)

*Primary Examiner* — Emmanuel M Marcelo
*Assistant Examiner* — Michael Gallion
(74) *Attorney, Agent, or Firm* — Rosenberg, Klein & Lee

(57) ABSTRACT

An apparatus is provided for dispensing a roll of sheet material in severable portions therefrom. The apparatus comprises a housing having a rim portion longitudinally offset from a base portion by a sidewall portion extending therebetween. The base and sidewall portions define a compartment for holding the roll of sheet material, and the sidewall portion includes a longitudinally extended dispensing slot formed therethrough communicating with the compartment. The sidewall portion forms about the dispensing slot at least one tapered edge. A lid is detachably coupled to the rim portion of the housing to enclose the compartment, and includes a bottom surface portion. A pivot structure is formed on at least one of the base and bottom surface portions to pivotally engage an axial end of the roll of sheet material for angular displacement thereon.

18 Claims, 7 Drawing Sheets

(56) References Cited

U.S. PATENT DOCUMENTS

| | | | | | |
|---|---|---|---|---|---|
| 4,936,452 | A | * | 6/1990 | Pauley | 242/588.6 |
| D316,789 | S | | 5/1991 | McLaughlin | |
| D326,203 | S | * | 5/1992 | Butler | D6/522 |
| 5,205,455 | A | * | 4/1993 | Moody | 225/106 |
| 5,305,937 | A | * | 4/1994 | Barnett | 242/594.6 |
| 5,367,827 | A | * | 11/1994 | Tajima et al. | 49/352 |
| 5,598,987 | A | * | 2/1997 | Wachowicz | 242/597.8 |
| 5,611,455 | A | | 3/1997 | McCreary | |
| 5,729,955 | A | * | 3/1998 | Yamada | 53/412 |
| D412,439 | S | * | 8/1999 | Cormack | D9/425 |
| D422,170 | S | * | 4/2000 | Harris, Jr. | D6/521 |
| 6,193,059 | B1 | * | 2/2001 | Massaro | 206/225 |
| 6,422,503 | B1 | * | 7/2002 | Hoo Kong | 242/559.4 |
| 6,499,626 | B1 | * | 12/2002 | Julius | 221/63 |
| 6,769,542 | B2 | * | 8/2004 | Polito | 206/361 |
| D501,722 | S | * | 2/2005 | Zimmerman | D3/294 |
| 7,032,854 | B2 | * | 4/2006 | Marsden | 242/388.1 |
| D551,477 | S | * | 9/2007 | Kikuchi | D6/522 |
| 7,287,667 | B2 | * | 10/2007 | Brown et al. | 221/227 |
| 7,497,351 | B2 | * | 3/2009 | Amundson et al. | 221/96 |
| 8,245,865 | B2 | * | 8/2012 | Damaghi et al. | 220/254.5 |
| 8,800,910 | B2 | * | 8/2014 | Shepherd | 242/597.8 |
| 2003/0089818 | A1 | * | 5/2003 | Reau et al. | 242/588.6 |
| 2004/0069894 | A1 | | 4/2004 | Murawski | |
| 2004/0099681 | A1 | * | 5/2004 | Julius | 221/63 |
| 2005/0167544 | A1 | * | 8/2005 | Elliott et al. | 242/597.8 |
| 2005/0263534 | A1 | * | 12/2005 | Wu et al. | 221/63 |
| 2007/0262191 | A1 | | 11/2007 | Amron | |
| 2007/0278227 | A1 | * | 12/2007 | Damaghi et al. | 220/254.5 |
| 2009/0065629 | A1 | * | 3/2009 | Veit | 242/588.3 |
| 2011/0297781 | A1 | * | 12/2011 | Peters | 242/615 |
| 2012/0168554 | A1 | * | 7/2012 | Blunt et al. | 242/588.2 |

* cited by examiner

FREE STANDING DISPENSER APPARATUS FOR ROLLED SHEET MATERIAL

RELATED APPLICATION DATA

This Application is based on Provisional Patent Application No. 61/676,143, filed 26 Jul. 2012.

BACKGROUND OF THE INVENTION

The present invention is directed to an apparatus for dispensing a roll of sheet material in severable portions. More specifically, the present invention is directed to a free standing dispenser apparatus for inconspicuously storing a roll of sheet material to be dispensed in simple yet stable manner therefrom in severable portions. The apparatus provides for conveniently holding the roll of sheet material so that sheet portions may be severed as needed therefrom for use.

The present invention finds wide application in various applications, such as in the technical field of kitchen accessories. For example, the present invention finds wide and various application in the particular field of portable paper towel, tissue, or other such paper wipe roll dispensers (collectively referred to herein as paper towel dispensers). Many types of portable paper towel roll dispensers are known in the art. Many types make use of either a base with a vertical support to hold the paper towel roll in a vertical, standing position. Other types make use of fixed in place paper towel roll dispensers often utilize a mounting system on a wall or under a cabinet, with the roll held to extend in a generally horizontal orientation. Whether vertical or horizontal, most prior art paper towel roll dispensers fail to conceal very much of the paper towel roll, settling for unsightly open exposure of the same. The drawbacks of this go beyond mere aesthetics, as the paper towel roll thus remains exposed and vulnerable to wetness or soiling, when a user with wet or soiled hands makes contact with the paper towel roll. Undue contamination risks and general unsanitary conditions may be cultivated as a result.

Some portable paper towel roll dispensers are known which conceal the entire roll. But they are encumbered by many of the same drawbacks encumbering open types of paper towel roll dispensers, as they require excessive user handling in order to access and tear off only the needed portions of the rolled paper towel. In addition, such portable dispensers have been configured with material compositions and structures offering little if any adaptation to the wide variety of kitchen and dining room designs. They often employ complex mechanical components with moving parts which not only make for complicated and unstable operation but subject them to periodic breakdown. Many also employ a separate base member to which a cover is attached. The cover on such known portable dispensers tends to be easily dislodged or seated in unstable manner during use, and often precludes one-hand operation to tear off a sheet for use. These portable dispensers are therefore inconvenient to use, or suffer from such poor functionality as the roller unraveling out of control or failing to leave a subsequent sheet in a ready position to be easily grabbed and torn off.

Numerous stationary type paper towel roll dispensers are also known in the art which conceal the entire roll. But such dispensers tend to incorporate mechanical devices having moving parts. Mounted as they typically are to a wall or under a counter, they cannot be easily moved. They are also made with material and structural configurations whose functional aspects conspicuously clash with the design and décor typical of private residential settings.

There is, therefore, a need for an apparatus which provides inconspicuous storage of a paper towel or other roll of sheet material which overcomes the drawbacks of known roll dispensers and maintains convenient, stable dispensing of the sheet material portions in severable portions.

SUMMARY OF THE INVENTION

It is an object of the present invention to provide an apparatus which provides protective, concealed storage of a sheet material roll for on demand dispensing in severable portions therefrom.

It is another object of the present invention to provide an apparatus having simple structure for stable free standing support of a sheet material roll to be dispensed in severable portions therefrom.

It is yet another object of the present invention to provide an apparatus having simple structure for ergonomic, one-handed operation to effect dispensing of a sheet material roll in severable portions therefrom.

These and other objects are attained by an apparatus for dispensing a roll of sheet material in severable portions therefrom. The apparatus comprises a housing having a rim portion longitudinally offset from a base portion by a sidewall portion extending therebetween. The base and sidewall portions define a compartment for holding the roll of sheet material, and the sidewall portion includes a longitudinally extended dispensing slot formed therethrough communicating with the compartment. The sidewall portion forms about the dispensing slot at least one tapered edge. A lid is detachably coupled to the rim portion of the housing to enclose the compartment, and includes a bottom surface portion. A pivot structure is formed on at least one of the base and bottom surface portions to pivotally engage an axial end of the roll of sheet material for angular displacement thereon.

In certain embodiments of the present invention, a free standing dispenser apparatus is provided for inconspicuously storing a roll of sheet material to be dispensed therefrom in severable portions. The apparatus comprises a housing having a rim portion longitudinally offset from a base portion by a sidewall portion extending therebetween, with the base and sidewall portions defining a compartment for holding the roll of sheet material. The sidewall portion is substantially cylindrical in contour and includes a longitudinally extended dispensing slot formed therethrough communicating with the compartment. The sidewall portion forms about the dispensing slot at least one tapered edge. A lid is detachably received in cradled manner within the rim portion of the housing to enclose the compartment, which lid includes a bottom surface portion. A partial dowel protrusion is formed on at least one of the base and bottom surface portions to protrude axially into the compartment for coaxially engaging the roll of sheet material thereon.

In certain other embodiments of the present invention, a free standing dispenser apparatus is provided for dispensing a roll of paper wipe material in severable portions therefrom. The apparatus comprises a housing having a rim portion longitudinally offset from a base portion by a sidewall portion longitudinally graduated in thickness extending therebetween. The base and sidewall portions define a compartment for holding the roll of paper wipe material, with the sidewall portion being substantially cylindrical in contour and having a longitudinally extended dispensing slot formed therethrough communicating with the compartment. The dispensing slot undulates in contour along the sidewall portion of the housing, and forms about the dispensing slot at least one tapered edge. A lid is detachably received in cradled manner within the rim portion of the housing to enclose the compartment, which lid includes a bottom surface portion. First and second partial dowel protrusions are formed to respectively protrude from the base and bottom surface portions axially into the compartment for coaxially engaging the roll of paper wipe material therebetween when the lid is coupled to the rim portion of the housing. A portion of the paper wipe material emerging outward from the dispensing slot may be severed from the roll thereof by one handed application of severing force on the emerging portion.

BRIEF DESCRIPTION OF THE DRAWINGS

Reference should be made to the following detailed description read in conjunction with the accompanying drawings. In the following drawings, like reference numerals designate like parts throughout the drawings.

DETAILED DESCRIPTION OF THE PREFERRED EMBODIMENTS

Figure 1:
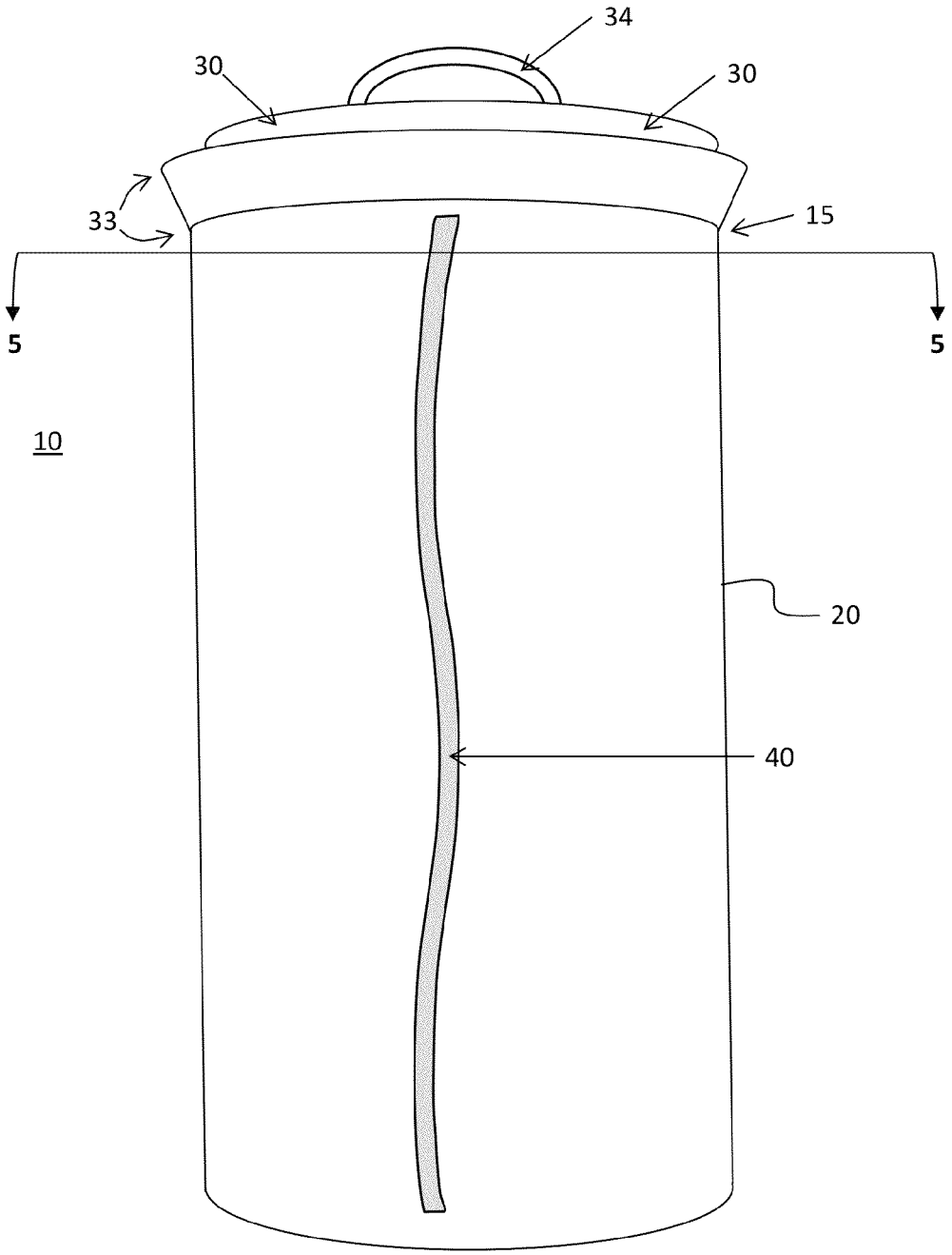
FIG. 1 is a front perspective view illustrating a dispenser for a roll of sheet material formed in accordance with one exemplary embodiment of the present invention.

The present description is of the best presently contemplated mode of carrying out the invention. This description is made for the purpose of illustrating the general principles of the invention and should not be taken in a limiting sense.

Briefly, a dispenser apparatus formed in accordance with an exemplary embodiment of the present invention serves to provide inconspicuous, protective storage of a paper towel or other roll of sheet material while keeping it readily accessible to dispense in severable portions on demand. The dispenser apparatus substantially secludes the roll within a safely covered housing while maintaining a terminal end of the sheet material roll ergonomically accessible from outside the housing. A user may grasp and sever a sheet material portion from the roll in convenient, effortless one-handed motion. The dispenser apparatus is preferably formed with a portable free standing configuration of sufficient stability that a user may preferably grasp just the sheet material emerging from the housing and pull so as to sever the same from the stored roll without having to hold or otherwise secure the housing or any other part of the dispenser apparatus itself.

The sheet material roll is suitably held within a protective compartment defined by the housing and enclosed therein by a protective lid placed over the housing. The housing includes a base portion and a sidewall portion that extends longitudinally upward from the base portion to a preferably open rim portion. The sidewall portion includes a longitudinally extended dispensing slot formed therethrough to communicate with the compartment. This dispensing slot provides open access through which a terminal end of the rolled sheet material may be passed to emerge out of the housing for a user to grasp, pull, and tear off as needed. A user may certainly pull more than a needed length of the sheet material out through the dispensing slot, then grasp with both hands to tear one portion of the sheet from the other. This usually proves quite inconvenient, especially where the user's otherwise free hand is also wet or soiled, or otherwise occupied with another task. Moreover, grasping then releasing a residual portion of the sheet material on the roll once a terminal portion is torn therefrom is likely to leave that residual portion wet, soiled, or at least with crinkled, stretched, or other unsightly disturbance.

In accordance with certain aspects of the disclosed embodiment, this scenario is largely obviated by forming the sidewall portion to define about the dispensing slot at least one tapered edge whose sectional contour converges to a severing tip. The severing tip extending along the tapered edge defines a fulcrum-like structure over which a terminal portion of the sheet material may be edge-pivoted and stretched—by use of but one hand—to sever the same from the remainder of the roll. The tapered edge preferably extends with the dispensing slot along a substantial part of the sidewall portion's longitudinal length. The tapered edge is preferably configured to trace a predetermined undulating contour longitudinally down the sidewall portion, so as to enhance its efficacy in severing the sheet material. Preferably, the tapered edge is thereby both curved and angled in shape.

Within the housing's enclosed compartment, the sheet material roll is suitably held in such manner that it rotates about one or more pivot structures responsive to a user's pulling force. At least one pivot structure is formed in this regard into either the base portion of the housing or a bottom portion of a covering lid. Preferably, a pivot structure is formed in both of these portions to coaxially oppose one another and cooperatively define a spindle-like structure for pivotal coaxial retention of the roll therebetween. Preferably, each pivot structure is formed in the illustrated embodiment to include a partial dowel protrusion extending axially into the chamber from one of the housing base or lid bottom portions. In alternate embodiments, any other suitable structures may be employed to provide pivotal retention of the sheet material roll. For instance, a pivot structure may be alternatively defined by recessed annular grooves formed in the given base or lid bottom portion for pivotal engagement by an axial end portion of the roll's core or the like.

Pivotal retention of the sheet material roll is preferably stabilized by suitably seating a removable lid over the housing to cover and enclose its compartment. Even without extraneous fastening measures, the lid is configured to seat securely upon the housing's rim portion. Preferably, the lid is formed with a bottom peripheral edge which is cradled within an outwardly flared (or radially tapered) surface of the rim portion. This seated engagement between the lid and rim portion not only provides self-centering and leveling when the lid is set in place on the housing, it leaves a wedged coupling that resists lateral dislodging of the lid, especially when the lid is formed of a material of substantial mass, strength, and density as ceramic, stone, metal, or the like.

The pivot structure contributed by the lid for retentive pivotal support of the sheet material roll's upper axial end then helps to stabilize the roll for smooth, even unrolling rotation. This obviates the need for an excessively long axial shaft or spindle structure to run contiguously from the housing's base portion up its entire longitudinal length.

The requisite stability for free standing operation which permits one handed removal of the severable sheet material portions from the roll is preferably augmented by graduating the housing's sidewall portion in thickness along its longitudinal length. The thickness is preferably graduated such that the sidewall portion is thicker and therefore heavier at its longitudinally lower portions than its longitudinally higher portions. In alternate embodiments, the housing's base portion may be configured or supplemented in this regard with any suitable weight augmenting measures known in the art. For example, where implementing variation in the housing's sidewall portion (and/or base portion) is not practicable, or is not sufficient to provide ample weighting to stabilize the dispenser apparatus, one or more weighting members may be applied to the housing as needed. This may be on the base portion, or on the sidewall portion at or near the base portion, to provide the needed stabilization.

Referring now to FIGS. 1-6, the exemplary embodiment disclosed is shown illustratively implemented for use as a dispensing apparatus for a paper towel of the type often found, for example, in kitchen and dining area settings. As shown, the disclosed embodiment provides a portable free standing paper towel roll dispenser that holds a single roll of continuous paper towels in a vertical orientation within a cylindrical shaped housing covered by a removable lid of predetermined configuration.

In this exemplary embodiment, the dispensing apparatus employs a simple two-piece structure that supports convenient one-hand tear operation in either clockwise or counter-clockwise unrolling direction. The apparatus guides this one-handed operation in such manner that the next residual sheet of the paper towel roll is left in a 'ready' position for convenient subsequent access, without excessive unraveling of the roll. The apparatus is configured to resist tipping and unwanted movement when subjected to the one-handed tearing operation. It provides stable internal support for the paper towel roll held within the housing, while permitting simple, easy replacement of the paper towel roll. With the lid in place, moreover, the apparatus substantially conceals and protects the entire paper towel roll within the more aesthetically pleasing form of the housing and matched lid which may be externally shaped and decorated as desired to suit the surrounding décor. The visually disruption of a paper towel and its holding mechanism are thereby replaced with the more artful and appealing form of a vase, jar, sculpture, or other attractive accessory blending harmoniously into the environment, especially with the apparatus turned so that its dispensing slot is not openly visible.

As mentioned, the disclosed embodiment of the present invention is described with reference to an implementation for holding and dispensing paper towel rolls of the kind typically used in household kitchen settings. Various other types of rolled towel- or tissue-like products may be supported in accordance with various embodiments of the present invention. Furthermore, the disclosed paper towel roll dispenser is preferably formed of a ceramic, stone, or similar materials. Any other suitable materials known in the art, such as plastic, wood, metal, various composites, or combinations thereof, may be used in alternate embodiments, depending on the particular application intended.

A paper towel roll generally includes an axially extended tube shaped core open at both axial ends, about which a continuous web of paper towel is wound (or rolled). Individual sheet portions of paper towels are delineated by perforations across the roll. The perforations define lines of weakness in the roll, to facilitate tearing of the roll into separate individual sheets of paper towels. Paper towel rolls of various types, and made for various uses, may be dispensed by the disclosed apparatus.

In the disclosed embodiment, the paper towel roll dispenser apparatus is of a free-standing and portable type, and is constructed to support a paper towel roll with its axis oriented vertically. The two-piece structure in this embodiment preferably combines numerous structural features, including a dispensing slot formed in a sidewall portion of a housing that is both curved and angled, a pair of built-in and coaxially opposed partial dowels, a lid and rim assembly of predetermined mated configuration, and a shaped structure of the housing which encloses the paper towel roll.

Figure 2:
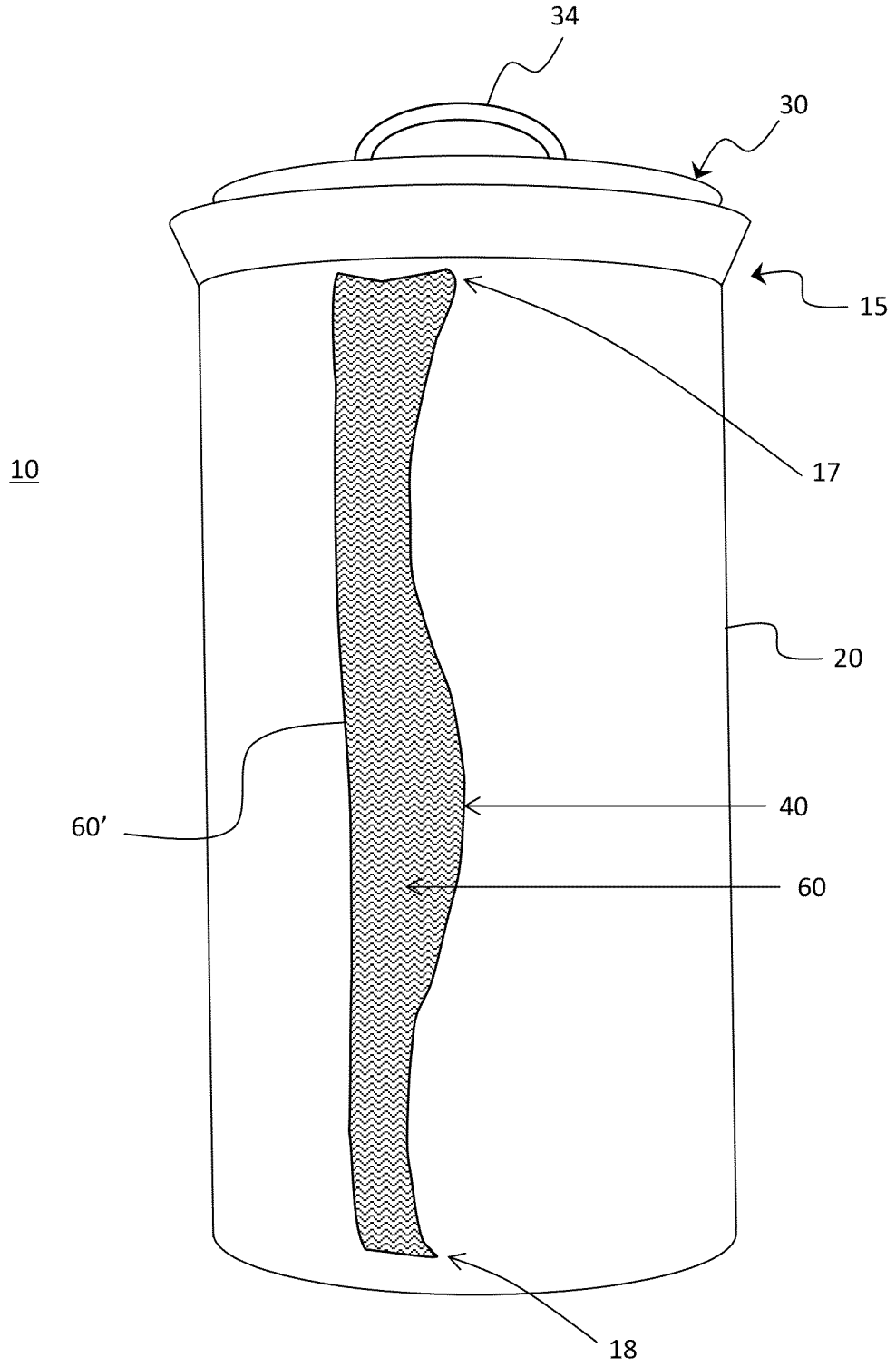
FIG. 2 is a front perspective view illustrating the embodiment of FIG. 1, with a terminal edge of a rolled sheet emerging through a vertical dispensing slot.
Figure 3:
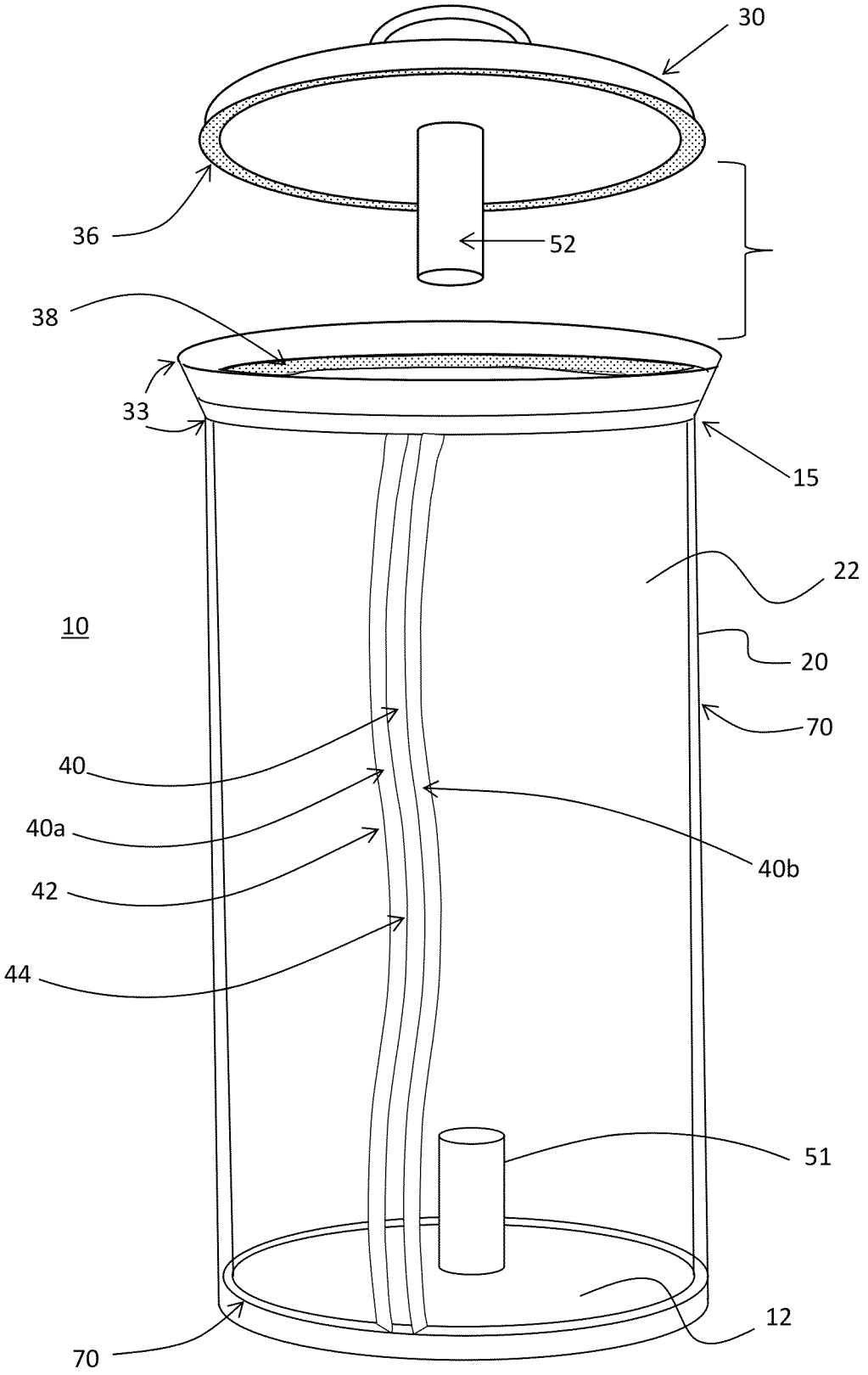
FIG. 3 is an exploded, partially transparent schematic view of the embodiment of FIG. 1.

Referring now in more detail to FIGS. 1-3, there is schematically shown a paper towel roll dispenser 10 formed in accordance with one exemplary embodiment of the present invention. While it may be of other suitable shapes (such as sectionally oblong, or of rectangular or other polygonal shape) in alternate embodiments, the dispenser 10 in the disclosed embodiment is preferably of cylindrical shape. The dispenser 10 includes a housing having a base portion 12, a rim portion 33, and a sidewall portion 20 extending longitudinally therebetween to collectively define a compartment 22. The housing's sidewall portion 20 is formed with a dispensing slot 40 which communicates with the compartment 22 to provide external access thereto. The dispenser 10 further includes a removable lid 30 detachably coupled to the rim portion 33 of the housing for covering the compartment 22.

A paper towel roll is stored within the compartment 22 during use (see FIG. 2), with its free end (or terminal sheet) passed partially through the dispensing slot 40, so that its outermost portion emerges externally from the housing. In the view of FIG. 1, the dispenser 10 is shown with no portion of the paper towel roll having yet been passed through the vertical dispensing slot 40. In FIG. 2, a terminal sheet 60 of the paper towel roll (having a terminal edge 60') is shown emerging outward through the slot 40 in a clockwise unrolling direction. As described in following paragraphs, the paper towel roll may be placed within the dispenser 10 in the disclosed embodiment so as to unroll, alternatively, in the opposite counter-clockwise direction without loss of dispensing efficacy.

The cylindrical housing in this embodiment is preferably formed of a rigid material of suitable strength and mass, and is preferably constructed as one continuous, integrally formed piece. Preferably, the only movable part of the dispenser is then the removable lid 30 (with its integrated handle 34) which may be removed for convenient access to the interior chamber 22 from the top for installing the paper towel roll. The paper towel roll may be inserted into the compartment to unroll in either angular direction. That is, the roll may be inserted so that the sheet roll is dispensed from left to right (clockwise), or right to left (counter-clockwise). Once the roll is installed and its free end passed out though the dispensing slot 40, single or multiple ply sheets may then be torn from the roll with a one-hand pull.

The rim portion 33 near the top 15 of the paper towel roll dispenser 10 is preferably configured to flare radially outward. The rim portion 33 thus forms an annular support on which the removable lid 30 may be simply yet securely seated. The rim portion 33 preferably flares to extend wider in diametric extent than the other portions of the dispenser 10. The diametric extent may be suitably varied for different applications; and, in certain illustrative applications the top of the rim portion 33 may range diametrically, for example, from about ¾ inch to 1 inch beyond the other portions of the paper towel roll dispenser 10 therebelow. The rim portion 33 is configured with sufficient longitudinal (or axial) depth, as measured for instance from its uppermost extent (which defines the top lip of the dispenser housing in this embodiment) to its lower-most extent, that it securely seats the removable lid 30 and guards against the lid's lateral dislodging movement. This longitudinal depth may vary depending on the particular requirements of the intended application; and, an exemplary range for certain applications is from approximately ¾ inch to 1¼ inches in longitudinal/axial depth for the radially flared or inclined surface of the inner rim portion within which the lid's bottom perimeter is gravitationally wedged when seated.

Those skilled in the art will recognize that the paper towel roll dispenser's housing may be suitably constructed with numerous overall shapes and forms. These include but are not limited to: a generally cylindrical shape, as shown in the disclosed embodiment FIG. 1, a generally triangular shape, and a multitude of other multi-sided shapes and forms.

FIG. 2 provides a view of the cylindrical paper towel roll dispenser 10 with the terminal (and in this case the first or initial) sheet 60 of the paper towel roll threaded through the vertical dispensing slot 40 ready for dispensing. In this illustration the paper towel roll has been installed in the cylindrical housing so that the roll flows from right to left (clockwise), but as described in preceding paragraphs the flow of the roll in the opposite (counter-clockwise) direction may be effected by simply reversing the angular orientation of the roll when it is placed in the compartment of the paper towel roll dispenser 10.

The vertical dispensing slot 40 is configured with such width and shape that a user may easily thread the first sheet therethrough. The dispensing slot 40 is preferably also configured to provide optimal assist in holding tension on the roll such that the roll is kept from unraveling when one or more sheets are unilaterally pulled and torn therefrom, and the following residual sheet is left in the ready position partially emerging from the housing. In the illustrated embodiment, the vertical dispensing slot 40 describes a soft continuous "S" shape extending longitudinally down the sidewall portion 20. The slot 40 preferably covers a height (longitudinally) that runs substantially the length of the dispenser housing from point 17 to point 18. Preferably, the slot is of a height and width that permits a sheet of the roll to pass freely through without obstruction or distortion. For example, a suitable height may be set to at least a standard axial span of a paper towel roll, and a suitable width may be set between approximately ⅜ inch and ½ inch. The slot 40 is preferably configured to maintain substantially consistent width from the top of the vertical slot 40 to the bottom.

Those skilled in the art will appreciate that depending on such factors as the material properties of the sheet material roll in question, or the relative dimensional configurations of the roll and dispenser, the vertical dispensing slot 40 may be formed with other suitable shapes, angles, and dimensions to optimize dispensing support. The vertical dispensing slot 40 may also be suitably varied in width of opening, depending on the particular requirements of the intended application.

FIG. 3 is an exploded schematic view of the paper towel roll dispenser 10, with certain portions removed (or made transparent) for illustrative purposes, to keep from obscuring other features. As shown in FIG. 3, the removable lid 30 is formed with an annular bottom perimeter 36 having a non-slip surface preferably formed or applied thereon. A lower inner surface part 38 of the flared rim portion 33 is preferably also formed or applied with a non-slip surface, so that when the removable lid 30 is seated in place on the flared rim portion 33, their respective non-slip surfaces are frictionally engaged to reinforce the lid's coupling to the housing. Any suitable non-slip surfacing measures known in the art may be employed in this regard, such as a roughening of the given surface in texture, application of a gripping, high friction coating or liner on the given surface, or the like. In certain alternate embodiments, moreover, such non-slip surface may be employed on one rather than both of the opposing lid and rim portion surfaces as shown.

Also shown is the built-in partial dowel protrusion 52 of the removable lid 30 and the built-in partial dowel system 51 integrated into the bottom of the paper towel roll dispenser 10. The two built-in partial dowels hold the paper towel roll vertical and stable within the paper towel roll dispenser 10 irrespective of whether the roll is full or substantially empty. The thickness of the cylindrical wall 70 is shown to gradually thicken from the top to the bottom of the cylinder.

In the current embodiment the length of the bottom built-in partial dowel protrusion 51 is between 1 inch to 2 inches and a diameter of ¾ inch to 1¼ inches. The built-in partial dowel protrusion 52 of the removable lid 30 has a length of 2 inches to 4 inches and a diameter ranging from ¾ inch to 1¼ inches. FIG. 3 also illustrates that the side walls 70, thicken gradually from near the top 15 of the cylinder to the bottom.

In the exemplary embodiment illustrated, the sidewall portion 20 of the dispenser 10 is preferably formed with a cylindrical wall configuration 70 that is graduated in sectional thickness. Preferably, this cylindrical wall 70 is gradually increased in thickness from the top 15 longitudinally down to the base portion 12. In certain illustrative applications, for example, the cylindrical wall 70 may gradually increase in thickness from approximately 3⁄16 inch at the top 15 to approximately ⅜ inch at the bottom near the base portion 12 for added weighting at the bottom. This enhances the free standing dispenser's stability, making it not only more resistant to tipping, but stronger as a support against and from which severable paper towel sheets are pulled off.

Also shown in FIG. 3 are the opposed pair of tapered, or angle, edges 40*a*, 40*b* between which the vertical dispensing slot 40 is defined. While described in more detail in following paragraphs with reference to FIGS. 5 and 6, the tapered edges 40*a*, 40*b* are each formed with a blade-like sectional contour converging from an inner point 42 to a severing tip 44, with a sloped guide surface extending therebetween. In the illustrated embodiment, such tapered edges 40*a*, 40*b* are disposed in mutually complementary manner. That is, the sloped guide surfaces respectively formed by the tapered edges 40*a*, 40*b* are oriented such that one facilitates dispensing of the paper towel roll in a first angular direction (such as a clockwise or counter-clockwise direction), while the other facilitates dispensing of the paper towel roll in a complementary second angular direction.

The paper towel roll dispenser should have sufficient weight to provide internal and external stability to avoid tipping and movement of the unit. Those skilled in the art will appreciate that sufficient weight may be provided by forming the paper towel roll dispenser 10 of any suitable material and construction to exhibit sufficient weight, density, strength, rigidity, and other such properties required for proper operation in a particularly intended application. Supplemental measures—such as adding extraneous weights to the lower portions of the dispenser 10, integrating extra weight or mass into the sidewall portion 20, integrating extra weight or mass into the base portion 12, or the like—may also be taken to the extent permitted by the particular requirements of the given application.

Figure 4:
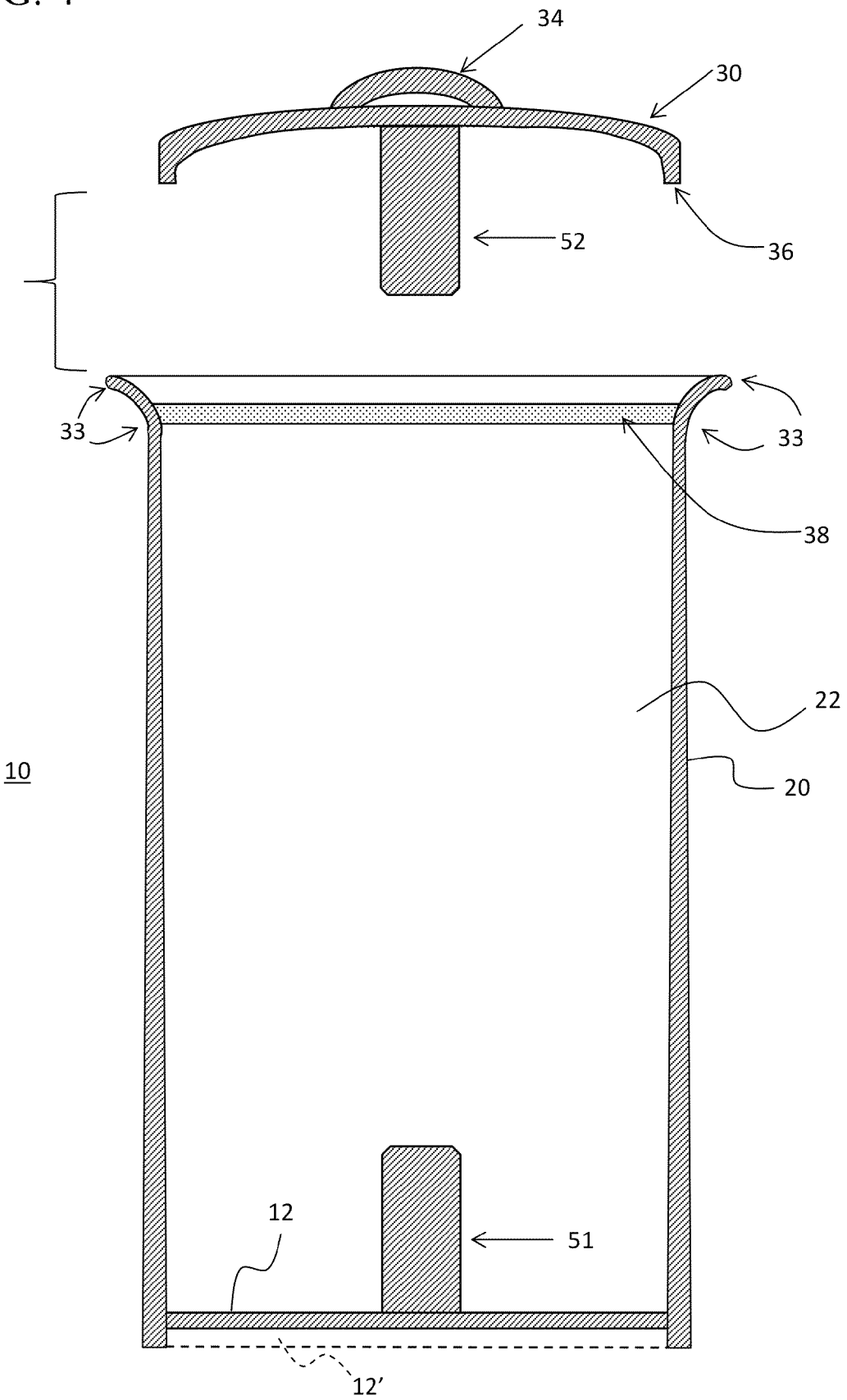
FIG. 4 is an exploded sectional view of the embodiment of FIG. 1.

An example is illustratively shown in FIG. 4, where one or more weighting members 12' are applied in alternate embodiments at or near the base portion 12 to provide weight augmentation for sufficient stabilization of the dispenser apparatus 10. In the example illustrated, one or more planar weighting plates 12' formed of metal, ceramic, stone, or any other material of suitable weight density is attached beneath the base portion 12. In other examples, the weighting members may take the form of weighted feet attached beneath the base portion 12 or to the bottom edge of the sidewall portion 20. In still other examples, suitable weight augmentation measures may be attached or applied to the inner or outer surface(s) of the sidewall portion 20 above and/or around the base portion 12. Such supplemental weighting measures prove particularly useful where graduating or otherwise varying these portions 20, 12 in thickness is cost- or manufacturing-wise prohibitive, or is simply not sufficient in itself to provide ample stabilization to the dispenser apparatus 10.

FIG. 4 is a longitudinal sectional view of the dispenser 10 as schematically shown in FIG. 3. As FIG. 4 shows, the dispenser 10 includes in the illustrated embodiment at least one pivot structure formed onto one or both of the housing's base portion 12 and the lid's inner/bottom surface. Each pivot structure provides for pivotal engagement of the given paper towel roll at one axial end, so that the roll may be stabilized within the housing's compartment, and remain rotatable therein about a pivot defined by the structure. In the exemplary embodiment shown, a pair of pivot structures are preferably provided: one on the base portion 12 and one underneath the removable lid 30. The pivot structures are preferably implemented as built-in partial dowel protrusions 51, 52 extending in coaxially opposed manner into the compartment, respectively from the base portion 12 and the bottom of lid 30. Each of the protrusions 51, 52 is preferably disposed substantially in coaxial alignment with housing and lid 30, but they may in alternate embodiments be offset from the precise axis of the housing and lid 30—so long a sufficient clearance is provided about the paper towel roll within the compartment to permit unobstructed rotation, and where more than one protrusion 51, 52 is employed such protrusions are disposed mutually in coaxial alignment.

Referring back to FIG. 4, the opposed built-in partial dowel protrusions 51, 52 cooperatively serve to stabilize the paper towel roll rotatably captured therebetween. The protrusions 51, 52 cooperate to hold the paper towel roll upright within the compartment 22, the bottom open end of the hollow cardboard tube/core at the center of the paper towel roll is inserted onto the bottom built-in partial dowel protrusion 51, and the lid 30 is placed onto the rim portion 33 so as to insert the top built-in partial dowel protrusion 52 into the top open end of the hollow cardboard tube/core. The seating engagement between the lid's bottom perimeter 36 and inner surface of the radially flared rim portion 33 yields a self-aligning of the top dowel protrusion 52 in this regard onto the roll's core tube for pivotal engagement.

The built-in partial dowel protrusions 51, 52 are each preferably formed with suitable length and width to engage and support the roll's core tube with sufficient stability. That is, the dowel protrusions 51, 52 cooperate to keep the roll consistently and freely rotatable yet without undue angular play about a substantially fixed upright axis extending through the compartment 22 throughout the life of the roll (irrespective of whether the roll is full or substantially empty). Each dowel protrusion 51, 52 is preferably formed in the illustrated embodiment with a cylindrical contour dimensioned to diametrically fill a substantial part of the roll's tubular core while preserving enough clearance to allow the core to turn freely thereon. Each dowel protrusion 51, 52 extends in axial length to insert coaxially into a sufficient length of the core to keep the roll from unintentional disengagement.

In one illustrative example, each of the partial dowel protrusions 51, 52 may be formed for instance with a length of approximately 2 inches to 4 inches and a diameter ranging from approximately ¾ inch to 1¼ inches. For different types and sizes of roll cores, the dowel protrusions 51, 52 may be formed with any other suitable dimensional configurations.

FIG. 4 also shows a sectional view of the removable lid 30 having a handle 34 formed at a top outer surface and the built-in partial dowel protrusion 52 extending from a bottom inner surface. In the exemplary embodiment illustrated, when the removable lid 30 is set in place within the flared rim portion 33, it is seated upon the non-slip lower portion 38 situated below the top lip of the dispenser housing. In one illustrative example, for instance, this may be approximately one inch or so below the top lip of the housing, with the diametric extent of the flared rim portion 33 reaching approximately ¾ inch to 1 inch beyond the rest of the dispenser's housing. In this illustrative example, the depth of the paper towel dispenser rim portion 33 would range approximately ¾ inch to 1¼ inches from the top lip of the dispenser to the lower portion 38 upon which the removable lid 30 is seated. One or both of the bottom perimeter 36 of the removable lid 30 and lower portion 38 of the flared rim portion 33 are preferably equipped with a non-slip material or texture that help hold the removable lid 30 stable during use. This may be implemented for example in the form of a silicone or other suitable treatment, coating, or interposed layer in certain embodiments, for example, or in the form of a roughened or otherwise surface treatment in other embodiments. The non-slip contact serves to maintain consistent support on the paper towel roll held via the lid's dowel protrusion 52 within the dispenser's compartment 22, the frictional engagement preventing the lid 30 from slipping and dislodging when the paper towel roll dispenser 10 is in use.

As mentioned in preceding paragraphs, those skilled in the art will appreciate that either a single or partial double dowel system may be employed. A single dowel system may be attached to either the base portion 12 or lid 30, with any suitable length and diameter. In one illustrative example, for instance, a single dowel protrusion may be configured with a length ranging from approximately ¾ inch to 14 inches and a diameter from approximately ½ inch to 1½ inches. In another illustrative example, a partial double dowel system may employ dowel protrusions extending from the base portion 12 and lid 30 each with a length ranging from approximately ¾ inch to less than 14 inches and a diameter ranging from approximately ½ inch to 1½ inches, with the combined length of the two protrusions generally not exceeding 14 inches.

Figure 5:
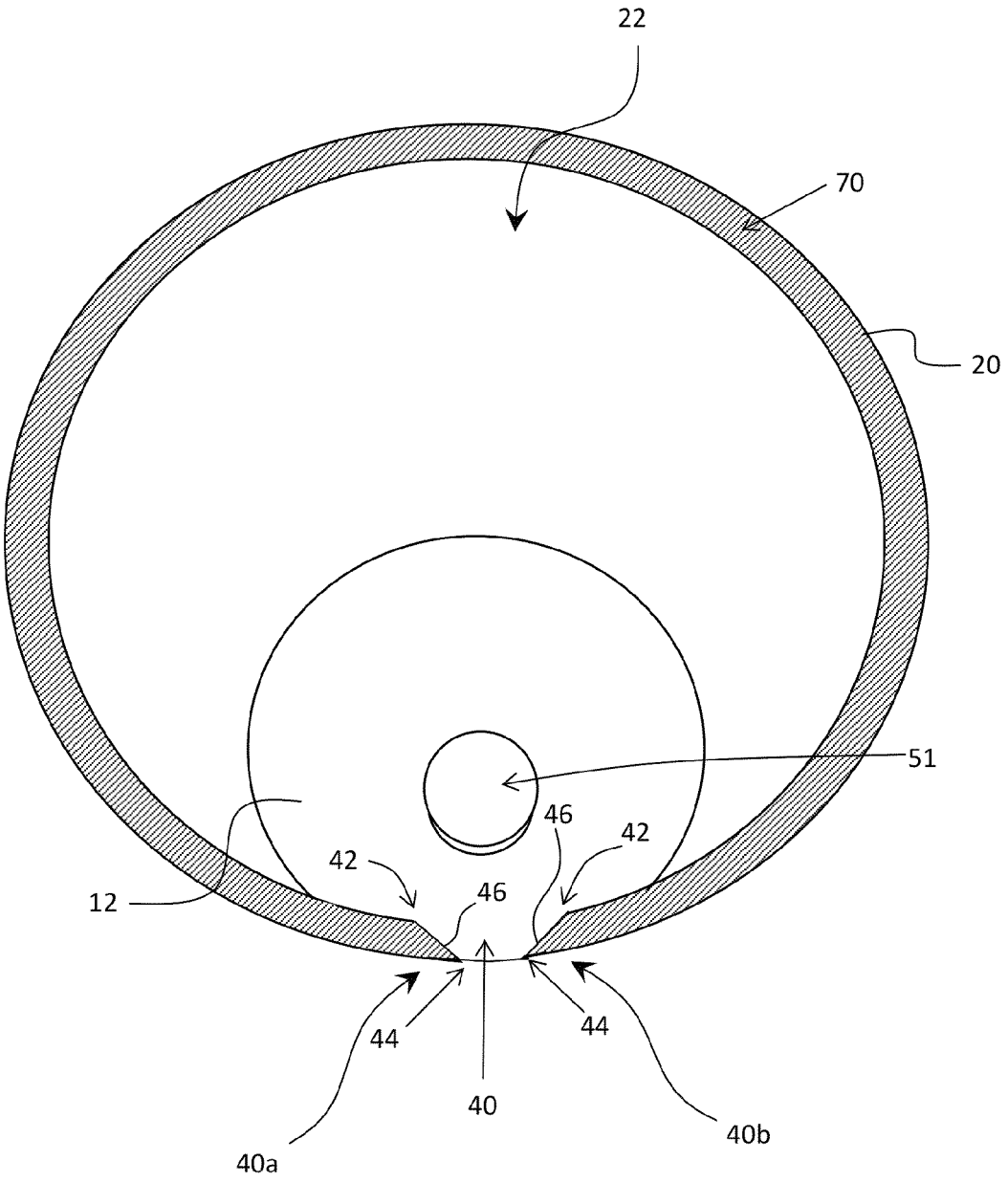
FIG. 5 is a schematic perspective view from a frontal angle of the embodiment of FIG. 1, with a section taken along line 5-5 and certain portions removed from view for clarity.

Turning next to FIG. 5, there is shown a simplified sectional view of the dispenser 10 taken along lines 5-5 in FIG. 1. Shown in FIG. 5 are the interior compartment 22 defined by the cylindrical wall 70 and base portion 12, as well as the bottom built-in partial dowel protrusion 51 and vertical dispensing slot 40. The opposed tapered edges 40*a*, 40*b* formed on opposed lateral sides of the vertical dispensing slot 40 are shown converging in sectional contour between the internal points 42 to external tips 44. A sloped guide surface 46 extends between the internal point 42 and external tip 44 on one side of the dispensing slot 40, such that a sheet of paper towel tangentially stretched out from the roll in an angular direction consistent with its slope is guided by the surface 46 out through the dispensing slot 40. Another complementary sloped guide surface 46 similarly extends between the internal point 42 and external tip 44 on the opposing side of the dispensing slot 40, such that a sheet of paper towel tangentially stretched out from the roll in an angular direction consistent with its slope is guided accordingly by that complementary surface 46 out through the dispensing slot 40.

The paper towel sheet guided along one sloped surface 46 may then be pulled against the edge defined by the corresponding sectional tip 44 to sever the sheet from the roll, whereupon the residual part of the roll from which the sheet is severed is left exposed and ready for subsequent dispensing at the dispensing slot 40. The severing edge defined by the sectional tip 44 thus acts much like fulcrum against which a user may pivot a sheet of paper towel pulled from the roll to sever the same by a sharp one-handed tugging action. The complementary severing fulcrums thus provided by the tapered edges 40*a*, 40*b* make such severing available for both clockwise and counter-clockwise dispensing of sheets from the roll through the slot 40.

Preferably, the severing fulcrum edges defined by the sectional tips 44 are not so sharp as to risk injury when touched by a user (either during use or during installation when the free end sheet of a paper towel roll is threaded through the vertical dispensing slot 40). Each edge, however, is preferably formed with sufficient acuity that the given paper towel roll (whether perforated or not perforated) may be severed thereagainst by a unilateral pulling action on a free end portion. The optimal geometry required for the severing edges will depend on various factors prevailing in the particular application intended—factors such as the material properties of the roll of sheet material being dispensed, the relative size and weight of the dispenser 10 as implemented, and the like.

In the illustrated embodiment, the thickness of the cylindrical wall 70 is maintained throughout the housing to allow for angling of the sloped guide surfaces 46 from the interior surface to the exterior surface at the vertical dispensing slot 40. In one illustrative example, for instance, a cylindrical wall 70 thickness ranging from approximately 3/16 inch to 3/8 inch is employed to provide sufficient area for ample surface friction, and thereby enable a user to easily and cleanly tear off a paper towel sheet. In the illustrated embodiment the sloped guide surfaces 46 at either side of the vertical dispensing slot 40 each preferably range between 40 degrees and 45 degrees, though any suitable angle configuration may be employed as needed. Preferably, the guide surfaces 46 and severing edges 44 at both sides of the vertical slot 40 are formed with similar angles and edge tolerances to facilitate even tearing action of individual paper towel sheets when pulled in either direction.

Those skilled in the art will recognize that various guide surface angles may be defined at the tapered edges 40*a*, 40*b* about the vertical dispensing slot 40. In the illustrated embodiment, for example, suitable angles may between 10 degrees to 89 degrees, and may taper inward, outward, or meet congruently.

Those skilled in the art will also recognize that the vertical dispensing slot 40, as shown in the current embodiment, need not be as vertically oriented as that shown in the illustrated embodiment. The dispensing slot 40 in alternate embodiments may be formed with various configurations deviating from the generally vertical configuration shown. Moreover, the shape traced by the dispensing slot 40 along the sidewall portion 20 of the dispenser housing may be suitably varied as required for the particular application intended.

Figure 6:
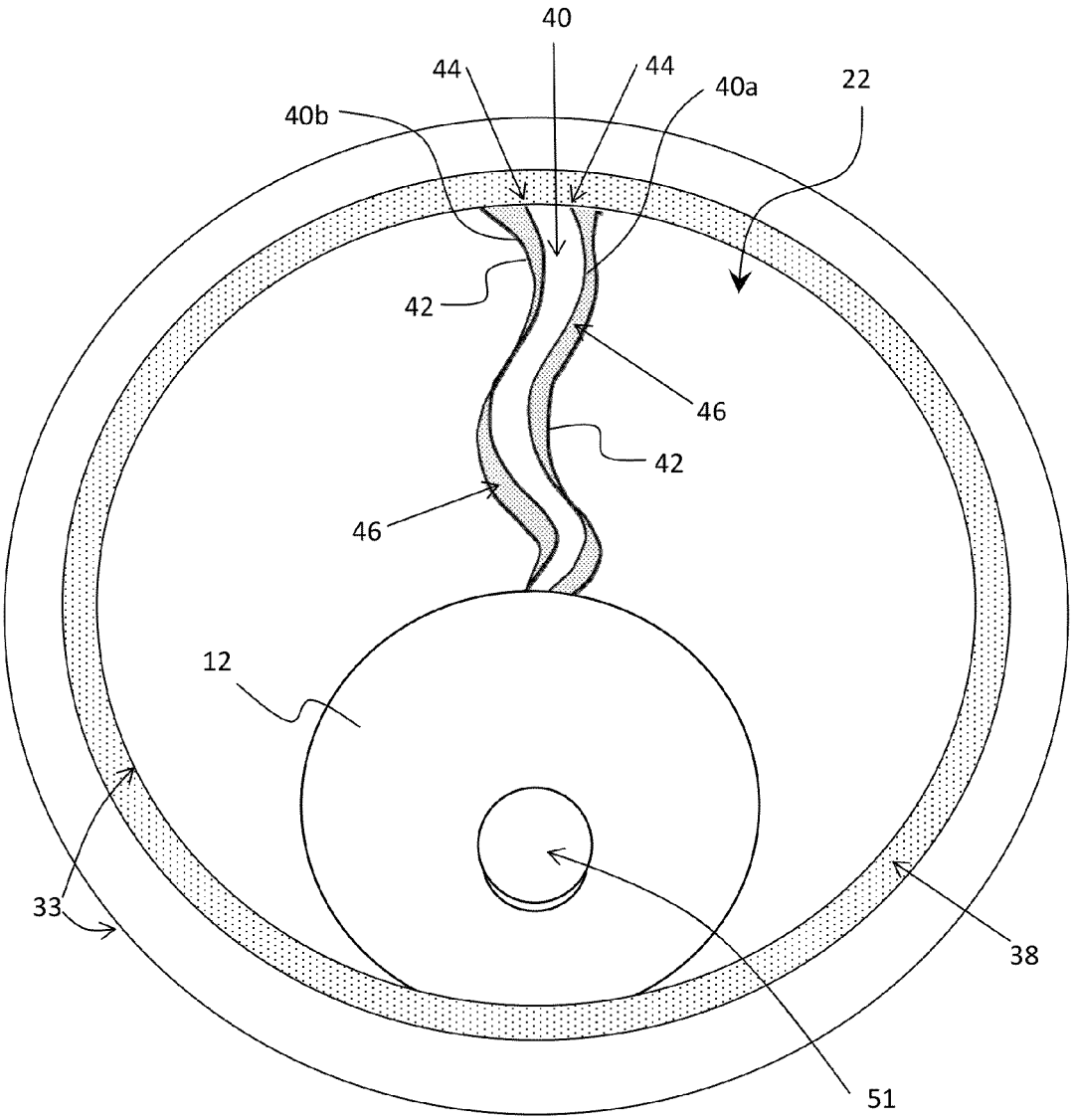
FIG. 6 is a schematic perspective plan view from a rear angle of the embodiment of FIG. 1, shown with the lid removed.

Referring to FIG. 6, there is shown in perspective a top-down view into the chamber 22 of dispenser 10, with the lid 30 removed. Shown clearly in FIG. 6 is the flared rim portion 33 with its lower part 38 preferably presenting a non-slip surface for the lid, as well as the bottom partial dowel protrusion 51 extending upward from the base portion 12. Also shown in FIG. 6 is the curvilinear shape traced by the vertical dispensing slot 40 down the sidewall portion 20 in the illustrated embodiment of dispenser 10. This shape generally forms a vertically oriented, soft "S" curved slot 40 bilaterally fed along its entire longitudinally extended length by sloped guide surfaces 46 each angled down from an internal point/delineation 42 down to the external edge/sectional tip 44 at opposing sides. The undulating curvature of the dispensing slot 40 accentuates its function as a severing fulcrum, as the uneven points of contact result in the uneven distribution of severing force along the longitudinal span of sheet material pivoted and pulled taught against the fulcrum. The user's pulling force is thereby focused on acute portions of the sheet material span, expediting the process of severing, and lessening the requisite force.

Those skilled in the art will recognize that the dispensing slot 40 may be formed with various other suitable shapes in this regard. Such other shapes, for example, as a crescent shape having one main bulbously contoured intermediate extension, an undulating having more jaggedly contoured undulations than those illustrated, or a relatively straight but inclined line shape, among others may be employed for the dispensing slot 40, depending on the particular requirements of the actually intended application.

Those skilled in the art will further recognize that the rim portion 33 may be formed with various suitable configurations other than that shown in the exemplary embodiment illustrated. Moreover, the lid 30 may be formed accordingly with numerous other configurations that may be suitable for the intended application.

Figure 7:
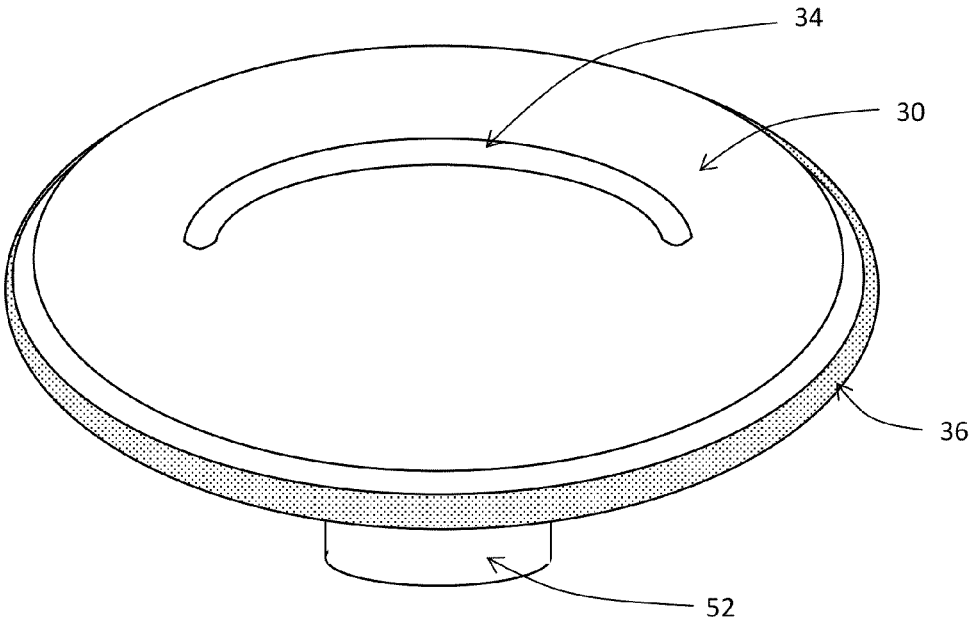
FIG. 7 is a perspective plan view of the removable lid portion in accordance with an alternate embodiment of the present invention; and, FIG. 8 is a perspective elevational view of the removable lid portion in accordance with another alternate embodiment of the present invention.

FIG. 7 illustrates the removable lid 30 as formed in accordance with an alternate embodiment of the present invention. In this embodiment, the lid 30 is similar in structure to that shown in the preceding embodiment in all respects, except that the built in partial dowel protrusion 52 is formed with a different relative dimensional configuration to suit a differently configured roll core. Also, the handle 34 is formed with one of numerous other suitable configurations which may be employed. In this example, the handle 34 is formed with a configuration that is stretched in its lateral dimension compared to that shown in the other embodiments illustrated. In other examples, the handle 34 may be formed with more elaborate shape, contour, and/or sculpted design features.

Figure 8:
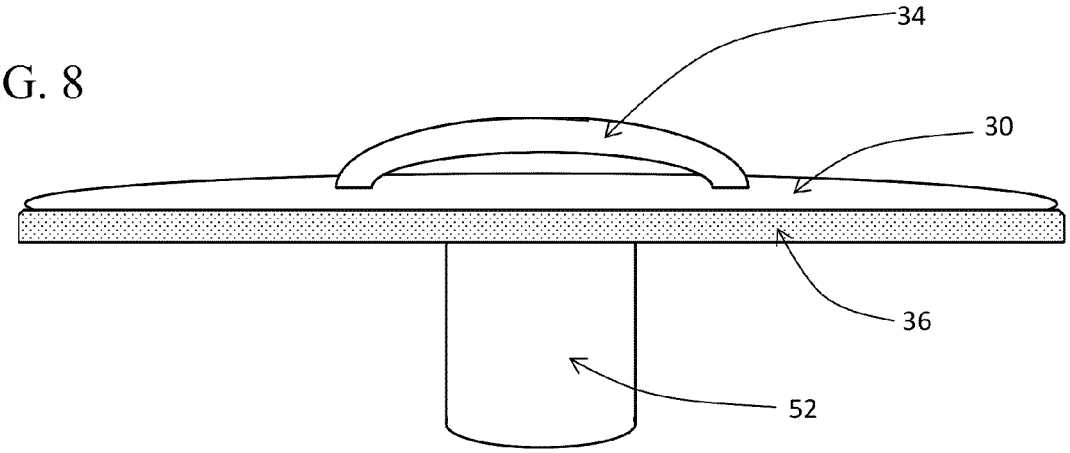

FIG. 8 shows a stand-alone elevation view of the lid 30 formed in accordance with yet another alternate embodiment of the present invention. In this embodiment, the lid 30 is of similar form as that shown in the embodiment of FIGS. 1-6, having a handle 34, built in partial dowel 52, and the non-slip lid bottom 36. In this embodiment, however, the built in partial dowel protrusion 52 is formed for example with a different relative dimensional configuration to suit a differently configured roll core.

As described in preceding paragraphs, the paper towel roll dispenser 10 may be constructed in certain alternate embodiments with a housing having a shape other than the generally cylindrical shape shown in the embodiment illustrated herein. In those alternate embodiments, the lid 30 would conform accordingly to the shape of the base upon which it is seated, be it cylindrical, square, triangular, multi-sided, or of some other geometric configuration.

The advantages realized in accordance with the present invention include, without limitation, the following. The dispenser 10, as formed in accordance with various embodiments, permits a simple one-hand tear operation in either clockwise or counter-clockwise dispensing direction. The dispenser 10 leaves the next residual sheet in 'ready' position for easy subsequent access and use. The dispenser 10 prevents unraveling of the paper towel roll during use, and is so configured and constructed that it prevents tipping and unwanted movement of the resulting structure during use. The dispenser 10 provides for internal stability for the paper towel roll it holds, and maintains sufficient tension on the paper towel roll for ease of tearing a sheet off with one hand, obviating the need for inconvenient and awkward re-raveling of the paper towel roll. The dispenser 10 further provides for easy installation of the paper towel roll and threading of the first sheet through the dispensing slot 40. The dispenser 10 is also portable, and may be conveniently moved from room to room for use on a countertop, table top, shelf, or any other open surface. The dispenser 10, moreover, conceals and protects substantially the entire unused portion of a paper towel roll.

In broad concept, a dispenser 10 formed in accordance with various embodiments of the present invention provides a vertically oriented container, preferably with a removable lid that conceals a paper towel roll and maintains ready access to a roll of sheet material through a dispensing slot. The dispenser 10 is preferably large enough to accept a wide range of sheet material roll sizes.

Although this invention has been described in connection with specific forms and embodiments thereof, it will be appreciated that various modifications other than those discussed above may be resorted to without departing from the spirit or scope of the invention as defined in the appended claims. For example, functionally equivalent elements or processes may be substituted for those specifically shown and described, certain features may be used independently of other features, and in certain cases, particular locations of the elements or processes may be reversed or interposed, all without departing from the spirit or scope of the invention as defined in the appended claims.

What is claimed is:

1. An apparatus for dispensing a roll of sheet material in severable portions therefrom, comprising:

a housing having a rim portion longitudinally offset from a base portion by a sidewall portion extending therebetween, said base and sidewall portions defining a compartment for holding the roll of sheet material, said sidewall portion having a longitudinally extended dispensing slot formed therethrough communicating with said compartment, said dispensing slot undulating in contour along said sidewall portion, said sidewall portion forming opposed first and second edges spaced apart by said dispensing slot for free unobstructed passage of the sheet material therebetween, wherein:

at least one of the first and second edges forms a tapered edge having a sectional contour converging towards said dispensing slot to define a guide surface terminating at a severing fulcrum for severing a portion of the sheet material thereagainst, and, said tapered edge defines uneven points of contact for the sheet material along the undulating contour of said dispensing slot for acutely focusing a severing force applied thereto against the severing fulcrum of said tapered edge;

a lid detachably coupled to said rim portion of said housing to enclose said compartment, said lid including a bottom surface portion; and, a pivot structure formed on at least one of said base and bottom surface portions to pivotally engage an axial end of the roll of sheet material for angular displacement thereon.

2. The apparatus as recited in claim 1, wherein said sidewall portion of said housing is longitudinally graduated in thickness.

3. The apparatus as recited in claim 2, wherein said sidewall portion of said housing is substantially cylindrical in contour.

4. The apparatus as recited in claim 1, comprising a first and a second of said pivot structures formed respectively on said base and bottom surface portions, said first and second pivot structures coaxially opposing one another when said lid is coupled to said rim portion of said housing.

5. The apparatus as recited in claim 4, wherein each of said first and second pivot structures includes a partial dowel protrusion extending axially into said compartment.

6. The apparatus as recited in claim 1, wherein said lid is received in cradled manner within said rim portion; and, said rim portion includes a flared annular surface supporting an annular lower periphery of said lid.

7. The apparatus as recited in claim 6, wherein at least one of said flared annular surface and said annular lower periphery includes a non-slip surface region.

8. The apparatus as recited in claim 1, wherein said first and second edges of said sidewall portion form a pair of tapered edges on opposing sides of said dispensing slot, said tapered edges each having a sectional contour converging towards said dispensing slot to define a guide surface and severing fulcrum for advancing and severing a portion of the sheet material beyond said dispensing slot.

9. The apparatus as recited in claim 8, wherein said dispensing slot extends substantially along a longitudinal length of said sidewall portion between said base and rim portions of said housing.

10. The apparatus as recited in claim 4, wherein said housing is formed of a material selected from the group consisting of: ceramic, plastic, wood, metallic, and composite materials.

11. A free standing dispenser apparatus for inconspicuously storing a roll of sheet material to be dispensed therefrom in severable portions, comprising:

a housing having a rim portion longitudinally offset from a base portion by a sidewall portion extending therebetween, said base and sidewall portions defining a compartment for holding the roll of sheet material, said sidewall portion being substantially cylindrical in contour and having a longitudinally extended dispensing slot formed therethrough communicating with said compartment, said dispensing slot undulating in contour along said sidewall portion, said sidewall portion forming opposed first and second edges spaced apart by said dispensing slot for free unobstructed passage of the sheet material therebetween, wherein:

at least one of the first and second edges forms a tapered edge having a sectional contour converging towards said dispensing slot to define a guide surface terminating at a severing fulcrum for severing a portion of the sheet material thereagainst, and, said tapered edge defines uneven points of contact for the sheet material along the undulating contour of said dispensing slot for acutely focusing a severing force applied thereto against the severing fulcrum of said tapered edge;

a lid detachably received in cradled manner within said rim portion of said housing to enclose said compartment, said lid including a bottom surface portion; and, a partial dowel protrusion formed on at least one of said base and bottom surface portions to protrude axially into said compartment for coaxially engaging the roll of sheet material thereon.

12. The free standing dispenser apparatus as recited in claim 11, wherein said rim portion includes a flared annular surface supporting an annular lower periphery of said lid, at least one of said flared annular surface and said annular lower periphery includes a non-slip surface region.

13. The free standing dispenser apparatus as recited in claim 12, comprising a first and a second of said partial dowel protrusions respectively extending from said base and bottom surface portions, said first and second partial dowel protrusions coaxially opposing one another when said lid is coupled to said rim portion of said housing.

14. The free standing dispenser apparatus as recited in claim 13, wherein at least one of said base and sidewall portions of said housing includes a weight augmentation member applied thereto.

15. The free standing dispenser apparatus as recited in claim 14, wherein said first and second edges of said sidewall portion form a pair of tapered edges on opposing sides of said dispensing slot, said tapered edges each having a sectional contour converging towards said dispensing slot to define a guide surface and fulcrum for advancing and severing a portion of the sheet material beyond said dispensing slot.

16. The free standing dispenser apparatus as recited in claim 15, wherein said housing is formed of a material selected from the group consisting of: ceramic, plastic, wood, metallic, and composite materials.

17. A portable dispenser apparatus for dispensing a roll of paper wipe material in severable portions therefrom, comprising:

a housing having a rim portion longitudinally offset from a base portion by a sidewall portion extending therebetween, said base and sidewall portions defining a compartment for holding the roll of paper wipe material, said sidewall portion being substantially cylindrical in contour and having a longitudinally extended dispensing slot formed therethrough communicating with said compartment, said dispensing slot undulating in contour along said sidewall portion of said housing, said dispensing slot undulating in contour along said sidewall portion, said sidewall portion forming opposed first and second edges spaced apart by said dispensing slot for free unobstructed passage of the paper wipe material therebetween, wherein:

at least one of the first and second edges forms a tapered edge having a sectional contour converging towards said dispensing slot to define a guide surface terminating at a severing fulcrum for severing a portion of the paper wipe material thereagainst, and, said tapered edge defines uneven points of contact for the paper wipe material along the undulating contour of said dispensing slot for acutely focusing a severing force applied thereto against the severing fulcrum of said tapered edge;

a lid detachably received in cradled manner within said rim portion of said housing to enclose said compartment, said lid including a bottom surface portion; and, first and a second partial dowel protrusions respectively protruding from said base and bottom surface portions axially into said compartment for coaxially engaging the roll of paper wipe material therebetween when said lid is coupled to said rim portion of said housing;

wherein at least one of said base and sidewall portions of said housing includes weight augmentation, and a portion of the paper wipe material emerging outward from said dispensing slot may be severed from the roll thereof by one handed application of severing force on the emerging portion.

18. The portable dispenser apparatus as recited in claim 17, wherein:

said rim portion includes a flared annular surface supporting an annular lower periphery of said lid, at least one of said flared annular surface and said annular lower periphery includes a non-slip surface region; and, said sidewall portion is longitudinally graduated in thickness for bottom weighting, and said first and second edges of said sidewall portion form a pair of tapered edges on opposing sides of said dispensing slot for bidirectionally selective dispensing of the paper wipe material therefrom, said tapered edges each having a sectional contour converging towards said dispensing slot to define a guide surface and severing fulcrum for advancing and severing a portion of the paper wipe material beyond said dispensing slot.

* * * * *